US009941592B2

(12) United States Patent
Clemente et al.

(10) Patent No.: US 9,941,592 B2
(45) Date of Patent: Apr. 10, 2018

(54) TRANSMITARRAY UNIT CELL FOR A RECONFIGURABLE ANTENNA

(71) Applicant: COMMISSARIAT À L'ENERGIE ATOMIQUE ET AUX ENERGIES ALTERNATIVES, Paris (FR)

(72) Inventors: Antonio Clemente, Seyssins (FR); Laurent Dussopt, Grenoble (FR); Bruno Reig, Moirans (FR)

(73) Assignee: COMMISSARIAT À L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 55 days.

(21) Appl. No.: 15/222,496

(22) Filed: Jul. 28, 2016

(65) Prior Publication Data

US 2017/0033462 A1 Feb. 2, 2017

(30) Foreign Application Priority Data

Jul. 28, 2015 (FR) ..... 15 57207

(51) Int. Cl.

| | |
|---|---|
| ***H01Q 1/38*** | (2006.01) |
| ***H01Q 1/48*** | (2006.01) |
| ***H01Q 9/04*** | (2006.01) |
| ***H01Q 1/22*** | (2006.01) |
| ***H01Q 3/46*** | (2006.01) |
| ***H01Q 21/00*** | (2006.01) |
| ***H01Q 23/00*** | (2006.01) |

(52) U.S. Cl.

CPC ..... *H01Q 9/0407* (2013.01); *H01Q 1/2283* (2013.01); *H01Q 1/38* (2013.01); *H01Q 1/48* (2013.01); *H01Q 3/46* (2013.01); *H01Q 21/0018* (2013.01); *H01Q 21/0093* (2013.01); *H01Q 23/00* (2013.01)

(58) Field of Classification Search

CPC .. H01Q 1/38; H01Q 1/48; H01Q 9/04; H01Q 9/0407; H01Q 1/2283; H01Q 21/0018; H01Q 21/0093; H01Q 23/00; H01Q 3/46

See application file for complete search history.

(56) References Cited

U.S. PATENT DOCUMENTS 4,777,490 A 10/1988 Sharma et al.
7,532,171 B2 * 5/2009 Chandler ..... H01Q 3/22 343/700 MS (Continued)

FOREIGN PATENT DOCUMENTS

WO 2012/085067 A1 6/2012

*Primary Examiner* — Tho G Phan

(74) *Attorney, Agent, or Firm* — Oliff PLC

(57) ABSTRACT

Unit cell including a receive antenna, a transmit antenna, and including first and second radiation surfaces separated from each other by a separation area, a phase-shift circuit comprising switches, each having an on, respectively off, state, wherein the corresponding switch allows, respectively blocks, the flowing of a current between the first and second radiation surfaces; a ground plane; a first printed circuit board including a first surface provided with the receive antenna, and a second opposite surface provided with the ground plane; a wafer of a semiconductor material including a first surface provide with first and second radiation surfaces and wherein the switches are formed in the separation area, monolithically with the transmit antenna.

16 Claims, 4 Drawing Sheets

(56) References Cited

U.S. PATENT DOCUMENTS

| | | | | |
|---|---|---|---|---|
| 8,013,784 | B2 * | 9/2011 | Margomenos | G01S 7/032 342/175 |
| 9,203,159 | B2 * | 12/2015 | Friedman | H01Q 21/065 |
| 9,484,619 | B2 * | 11/2016 | Korva | H01Q 1/243 |
| 2005/0035915 | A1 | 2/2005 | Livingston et al. | |
| 2012/0280380 | A1 | 11/2012 | Kamgaing | |
| 2016/0178730 | A1 * | 6/2016 | Trotta | G01S 7/006 342/175 |
| 2017/0085006 | A1 * | 3/2017 | Corman | H01Q 3/26 |

* cited by examiner

TRANSMITARRAY UNIT CELL FOR A RECONFIGURABLE ANTENNA

TECHNICAL FIELD

The present invention relates to a transmitarray unit cell for an antenna reconfigurable at an operating frequency, preferably in the range from 30 GHz to 110 GHz. The present invention also relates to a reconfigurable antenna comprising a transmitarray comprising such unit cells.

"Reconfigurable" means that at least one characteristic of the antenna can be modified during its lifetime, after the manufacturing thereof. The characteristics which can generally be modified are the frequency response, the radiation diagram (also called beam), and the polarization. The reconfiguration of the frequency response covers different functionalities such as frequency switching, frequency tuning, bandwidth variation, frequency filtering, etc. The reconfiguration of the radiation diagram covers different functionalities such as beam steering, beamwidth (that is, the concentration of the radiation along a specific direction), spatial filtering, beam or multibeam (for example, a plurality of narrow beams replacing a wide beam) forming, etc.

Regarding the reconfiguration of the radiation diagram, there are different types of reconfigurable antennas, especially:

- a phased array antenna,
- a reflectarray antenna,
- a transmitarray antenna.

Such reconfigurable antennas are particularly advantageous from the C band (4-8 GHZ) to the W band (75-110 GHz) for the following applications:

- driver assistance radars, in an active safety approach,
- very high resolution imaging and monitoring systems,
- very high rate millimeter-wave communication systems (inter-building or intra-building communications in a domotics or immotics environment),
- Ka-band LEO (Low Earth Orbit) ground-satellite telemetry connections, satellite telecommunications with a reconfigurable primary source (SOTM™ for Satcom-on-the-Move, Internet, Television etc.),
- point-to-point and point-to-multipoint link systems (metropolitan networks, "Fronthaul" and "Backhaul" systems for cellular networks, radio access for fifth-generation mobile networks, etc.).

The present invention more specifically relates to a reconfigurable antenna comprising a transmitarray at millimeter-range frequencies. A transmitarray comprises at least one radiation source preferably emitting in a spectral range from 30 GHz to 110 GHz, the radiation source(s) irradiating an assembly of unit cells.

BACKGROUND ART

A known transmitarray unit cell of the state of the art, particularly from document WO 2012/085067, comprises:

a planar receive antenna, intended to receive an incident wave;

a planar transmit antenna intended to transmit the incident wave with a phase shift, and comprising first and second radiation surfaces separated from each other by a separation area to be electrically isolated, the transmit antenna and the receive antenna being electrically connected to each other;

a phase-shift circuit configured to introduce the phase shift, and comprising switches each having an on, respectively off, state, wherein the corresponding switch allows, respectively blocks, the flowing of a current between the first and second radiation surfaces of the transmit antenna;

a ground plane having the receive antenna and the transmit antenna arranged on either side thereof;

a first printed circuit board comprising a first surface provided with the receive antenna, and a second opposite surface provided with the ground plane, a second printed circuit board comprising a first surface assembled on the ground plane by means of a bonding film, and a second opposite surface provided with the transmit antenna, where the first surface may be provided with switch biasing lines.

The phase-shift circuit of each unit cell enables to reconfigure the radiation diagram of the antenna comprising a transmitarray. The switches enable to modify the phase of the wave transmitted by each unit cell of the array. Such a transmitarray has many advantages:

- the power efficiency at microwave frequencies and particularly at millimeter-range frequencies (in the order of a few GHz) due to the transmission in air between the radiation source(s) and the unit cells,
- a decreased bulk, weight, and manufacturing cost due to the planar technology used (patch antennas on printed circuit boards),
- a radiation diagram having a good polarization purity since imperfections may mutually compensate within the array,
- a radiation diagram having a good quality in terms of shape of the beam and of the secondary lobes due to the position of the radiation source(s) located opposite the beam generated by the array.

To obtain satisfactory performances, the characteristic dimension of unit cells should be smaller than or equal to the half-wavelength of the radiation source(s). When the spectral field of the radiation source(s) is, in particular, in the range from 30 GHz to 110 GHz, the corresponding wavelength is smaller than 1 cm. Now, the switches are formed at the second surface of the second printed circuit board, in the separation area. The forming of the switches thus becomes a problem due to the small dimensions of the transmit antenna. The switches, arranged inside of a package and placed on the second surface of the second printed circuit board, are then likely to significantly degrade the unit cell performances. Indeed, the package of each switch tends to disturb the close environment of the first and second radiation surfaces, and thereby affects the radiation diagram of the transmit antenna. Further, electric connections are present between the package and the transmit antenna to make the corresponding switch functional. Such electric connections make the switch integration more complex, by taking up a non-negligible space in the separation area, which has a small size.

SUMMARY OF THE INVENTION

Thus, the present invention aims at overcoming all or part of the above-mentioned disadvantages, and relates for this purpose to a unit cell of a transmitarray for an antenna reconfigurable at an operating frequency, preferably in the range from 30 GHz to 110 GHz, the unit cell comprising:

- a receive patch antenna, intended to receive an incident wave;
- a transmit patch antenna intended to transmit the incident wave with a phase shift, and comprising first and second radiation surfaces separated from each other by a separation area so as to be electrically isolated;

a phase-shift circuit configured to introduce the phase shift, and comprising switches each having an on, respectively off, state, wherein the corresponding switch allows, respectively blocks, the flowing of a current between the first and second radiation surfaces of the transmit antenna;

a ground plane having the receive antenna and the transmit antenna arranged on either side thereof;

a first printed circuit board comprising a first surface provided with the receive antenna, and a second opposite surface provided with the ground plane;

wherein the unit cell comprises a wafer of a semiconductor material, electrically isolated from the ground plane, and comprising a first surface provided with the first and second radiation surfaces of the transmit antenna, and wherein the switches are formed at the first surface of the wafer, in the separation area, monolithically with the transmit antenna.

Term "wafer" designates a cut portion of an ingot of a semiconductor material, conventionally a disk, used as a base material to form components, in the case in point, switches.

"Semiconductor" means that the material has an electric conductivity at 300 K in the range from $10^{-8}$ to $10^{3}$ S/cm.

"Monolithic" means that the transmit antenna and the switches share a single substrate, in the case in point, the wafer. The transmit antenna and the switches are formed simultaneously during the same manufacturing method.

Thus, such a unit cell according to the invention enables to ease the integration of the switches in the separation area, despite the small dimensions of the transmit antenna, when the operating frequency is in the range from 30 GHz to 110 GHz. Indeed, the switches are formed on the wafer, monolithically with the transmit antenna. The switches are thus not placed on a printed circuit board (PCB), conversely to the state of the art, whereby there are no package and no electric connections between the package and the transmit antenna, which would have been likely to degrade the performances of the unit cell.

Further, the receive antenna and the transmit antenna are patch antennas. The receive antenna is formed at the first surface of the first printed circuit board, while the transmit antenna is formed at the first surface of the wafer. Thus, such a unit cell according to the invention uses a hybrid "PCB/wafer" integration for the receive/transmit antennas with a planar technology, which is favorable to an industrial production.

Advantageously, the unit cell comprises a second printed circuit board comprising a first surface assembled on the ground plane, and a second opposite surface, and the wafer is assembled to the second surface of the second board.

In an embodiment, the first surface of the wafer is assembled to the second surface of the second board. In an alternative embodiment, the wafer comprises a second surface opposite to the first surface, and the second surface of the wafer is assembled to the second surface of the second board.

Advantageously, the unit cell comprises a substrate of a dielectric material assembled to the second surface of the second board, and the substrate comprises a cavity shaped to receive the wafer.

"Dielectric" means that the material has an electric conductivity at 300 K smaller than $10^{-8}$ S/cm.

Thus, the substrate cavity enables to properly align the wafer with respect to the second printed circuit board.

Advantageously, the phase-shift circuit comprises a first assembly of electrically-conductive tracks, arranged at the second surface of the second board to polarize the switches.

The tracks are made of an electrically-conductive material. "Electrically conductive" means that the material has an electric conductivity at 300 K greater than $10^{3}$ S/cm. The electrically-conductive material is preferably a metal, more preferably copper.

Thus, such a second printed circuit board allows a biasing of the switches with a minimum bulk, without disturbing the radiation diagram of the transmit antenna.

Advantageously, the phase-shift circuit comprises:

a second assembly of electrically-conductive tracks, arranged at the first surface of the second board to bias the switches, vias formed in the second board to connect the first and second assemblies of electrically-conductive tracks.

Thus, such a second printed circuit board enables to increase the number of available biasing lines with a minimum bulk, without disturbing the radiation diagram of the transmit antenna. The vias ensure the electric connection between the first and second assemblies of electrically-conductive tracks.

Advantageously, the second surface of the second board comprises bump contacts, and the wafer comprises solder bumps soldered to the bump contacts to assemble the wafer to the second board.

Thus, the bump contacts and the solder bumps ensure a more robust assembly than a wire bonding, with less electromagnetic disturbances.

Advantageously, the bump contacts are electrically connected to the first assembly of electrically-conductive tracks, and the switches are electrically connected to the solder bumps.

Thus, a low-bulk vertical electric connection between the switches and the biasing lines is obtained.

Advantageously, the second surface of the second board comprises at least one cavity formed opposite the transmit antenna.

Thus, such cavities enable to decrease the effective dielectric constant seen by the transmit antenna.

According to an execution mode, each switch is a micro-electromechanical system comprising:

a fixed actuation electrode, formed at the first surface of the wafer;

a membrane, formed at the first radiation surface of the transmit antenna, and mobile between:

a first position, corresponding to the on state, where the membrane is in contact with the second radiation surface of the transmit antenna; and a second position, corresponding to the off state, where the membrane is distant from the second radiation surface of the transmit antenna.

In the present invention, term micro-electromechanical system (MEMS) also designates nano-electromechanical systems (NEMS).

Advantageously, the unit cell comprises an encapsulation layer arranged to encapsulate each micro-electromechanical system, the encapsulation layer being formed monolithically with the corresponding micro-electromechanical system.

Thus, such an encapsulation layer enables to improve the reliability of the corresponding micro-electromechanical system with no significant disturbance of the radiation diagram of the transmit antenna.

According to an alternative execution, each switch comprises:

an electrically-conductive element comprising a first portion formed at the first surface of the wafer, in contact with the first radiation surface of the transmit antenna, and a second portion extending opposite the second radiation surface of the transmit antenna;

a layer of a phase-change material, arranged between the second radiation surface of the transmit antenna and the second portion of the electrically-conductive element, the phase-change material having a crystal phase corresponding to the on state, and an amorphous phase corresponding to the off state.

"Electrically conductive" means that the element has an electric conductivity at 300 K greater than $10^3$ S/cm.

Thus, such switches are particularly compact as compared with MEMSs.

Advantageously, the phase-change material is selected from the group comprising GeTe, $Ge_2Sb_2Te_5$.

Thus, such chalcogenide alloys are phase-change materials which may be used as a memory.

Advantageously, the wafer has a resistivity greater than or equal to 2,000 Ω·cm.

Thus, such a resistivity enables to decrease dielectric losses as compared with a standard substrate for radio (RF) applications.

Advantageously, the semiconductor material of the wafer is based on silicon.

The present invention also relates to an antenna reconfigurable at an operating frequency, preferably in the range from 30 GHz to 110 GHz, comprising a transmitarray comprising a plurality of unit cells according to the invention.

BRIEF DESCRIPTION OF THE DRAWINGS

The foregoing and other features and advantages will be discussed in detail in the following non-limiting description of different embodiments of the invention, in connection with the accompanying drawings, among which.

DETAILED DESCRIPTION OF THE EMBODIMENTS

For the different embodiments, the same references will be used for identical elements or elements performing the same function, to simplify the description. The technical characteristics described hereafter for different embodiments are to be considered separately or according to any technically possible combination.

FIGS. 1 to 7 illustrate a unit cell 1 of a transmitarray RT for an antenna reconfigurable at an operating frequency, preferably in the range from 30 GHz to 110 GHz.

Figure 1:
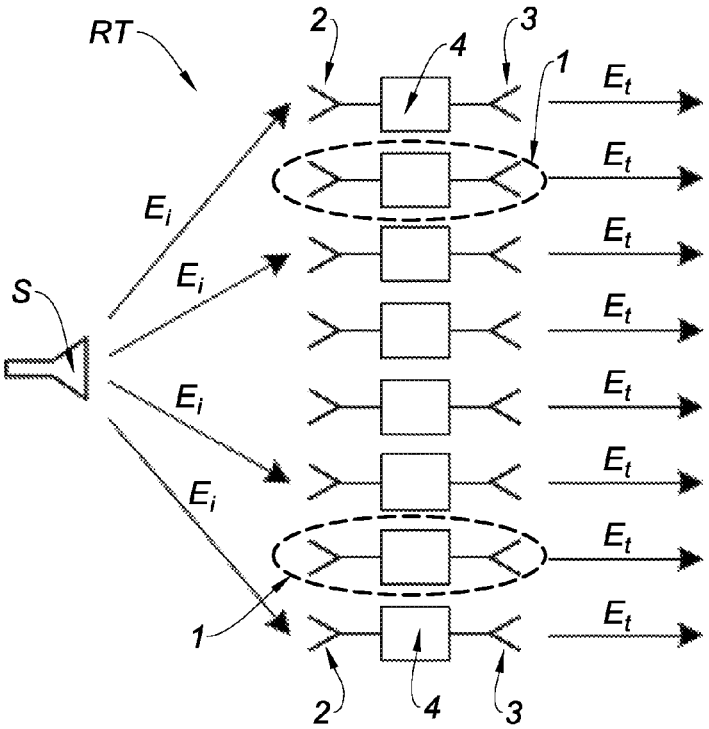
FIG. 1 is a simplified view of a reconfigurable antenna comprising a transmitarray.
Figure 2A:
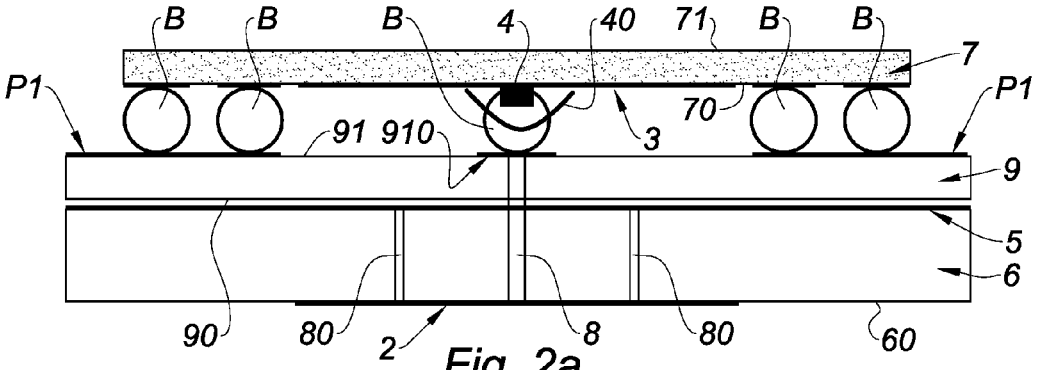
FIGS. 2*a* and 2*b* are simplified transverse cross-section views of a unit cell according to a first embodiment.
Figure 2B:
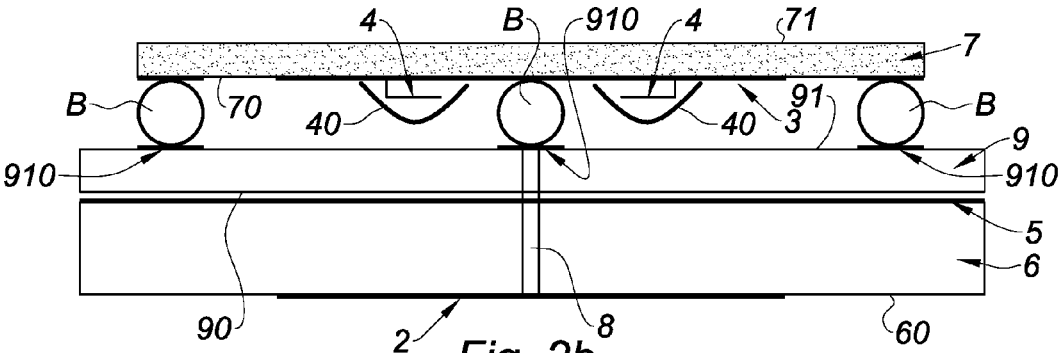
Figure 3:
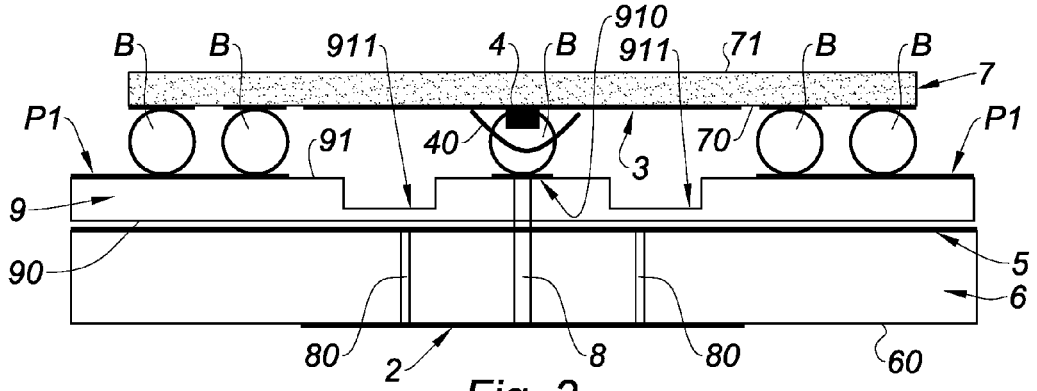
FIGS. 3 and 4 are simplified transverse cross-section views illustrating two execution modes of the unit cell according to the first embodiment.

Unit cell 1 comprises:

a receive patch antenna 2, intended to receive an incident wave $E_i$;

a transmit patch antenna 3 intended to transmit the incident wave $E_i$ with a phase shift (the phase-shifted transmitted wave $E_t$ being illustrated in FIG. 1), and comprising first and second radiation surfaces 30, 31 separated from each other by a separation area ZS (clearly apparent in FIG. 6) to be electrically isolated, transmit antenna 3 and receive antenna 2 being electrically connected to each other;

a phase-shift circuit configured to introduce the phase shift, and comprising switches 4 each having an on, respectively off, state, wherein the corresponding switch 4 allows, respectively blocks, the flowing of a current between the first and second radiation surfaces 30, 31 of transmit antenna 3;

a ground plane 5 having receive antenna 2 and transmit antenna 3 arranged on either side thereof;

a first printed circuit board 6 comprising a first surface 60 provided with receive antenna 2, and a second opposite surface provided with ground plane 5.

Unit cell 1 comprises a wafer 7 of a semiconductor material, electrically isolated from ground plane 5. Wafer 7 comprises a first surface 70 provided with the first and second radiation surfaces 30, 31 of transmit antenna 3. Switches 4 are formed at the first surface 70 of wafer 7, in separation area ZS, monolithically with transmit antenna 3. First surface 70 of wafer 7 is advantageously covered with a dielectric layer 700. Dielectric layer 700 is preferably an oxide of the semiconductor material. Wafer 7 advantageously has a resistivity greater than or equal to 2,000 Ω·cm. The semiconductor material of wafer 7 is preferably based on silicon. As an example, for a 60-GHz operating frequency, wafer 7 preferably has a thickness in the order of 100 μm.

Unit cell 1 advantageously comprises a second printed circuit board 9 comprising a first surface 90 assembled on ground plane 5, and a second opposite surface 91. Wafer 7 is assembled to second surface 91 of second board 9. In an embodiment, first surface 70 of wafer 7 is assembled to second surface 91 of second board 9. In an alternative embodiment (illustrated in FIGS. 5*a* and 5*b*), wafer 7 comprises a second surface 71 opposite to first surface 70, and second surface 71 of wafer 7 is assembled to second surface 91 of second board 9. Second surface 91 of second board 9 advantageously comprises at least one cavity 911 formed opposite transmit antenna 3. As an example, cavity or cavities 911 have a width in the order of 200 μm. As an example of embodiment, first and second boards 6, 9 are of Rogers RO3003 type, with a relative permittivity equal to 3. As an example, for a 60-GHz operating frequency, first board 6 preferably has a thickness in the order of 250 μm, and second board 9 preferably has a thickness in the order of 100 μm. Unit cell 1 advantageously comprises an adhesive film interposed between first and second boards 6, 9.

As illustrated in FIG. 1, transmitarray RT comprises at least one radiation source S preferably emitting in a spectral range from 30 GHz to 110 GHz, radiation source(s) S irradiating an assembly of unit cells 1.

Figure 7:
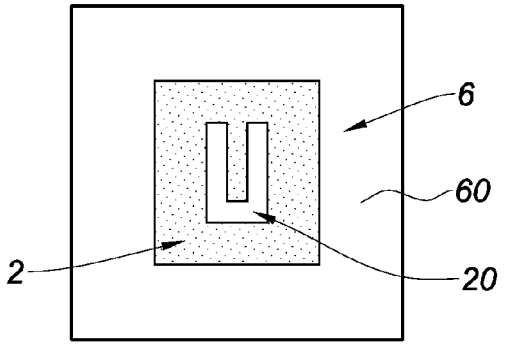
FIG. 7 is a partial simplified view of a unit cell according to the invention illustrating the receive antenna.

Receive antenna 2 is a patch antenna. As non-limiting examples, receive antenna 2 may be of square, rectangular, slot, circular, elliptic, triangular, spiral, or other type. Similarly, when receive antenna 2 is a slot antenna 20, slot 20 may for example have a U, rectangular, ring, circular, elliptic, or other shape. As illustrated in FIG. 7, receive antenna 2 is a U-shaped rectangular slot patch antenna 20.

Figure 6:
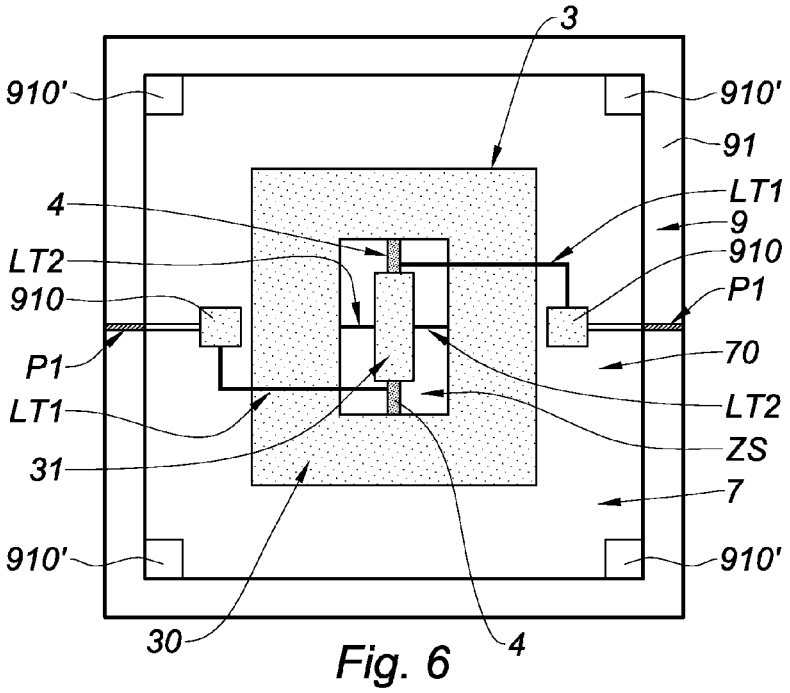
FIG. 6 is a partial simplified view, in transparency, of a unit cell according to the invention illustrating the transmit antenna.

Transmit antenna 3 is a patch antenna. As illustrated in FIG. 6, first and second radiation surfaces 30, 31 are separate. A slot is advantageously formed in transmit antenna 3 to electrically isolate first and second radiation surfaces 30, 31. The slot defines separation area ZS. The slot is preferably ring-shaped with a rectangular cross-section. Of course, other shapes can be envisaged for the slot, such as an elliptic or circular shape. According to an alternative execution, the electric isolation of the first and second radiation surfaces 30, 31 may be ensured by a dielectric material.

First and second radiation surfaces 30, 31 advantageously have an axis of symmetry to avoid degrading the polarization of transmitted wave $E_t$ by transmit antenna 3 by minimizing the excitation of unwanted resonance modes. First radiation surface 30 preferably forms a ring having a rectangular cross-section. Second radiation surface 31 preferably forms a rectangular strip. Second radiation surface 31 is advantageously enclosed in first radiation surface 30 to avoid the forming of parasitic currents. Additional radiation surfaces may advantageously be stacked on first and second radiation surfaces 30, 31 to increase the bandwidth of transmit antenna 3.

Receive antenna 2 and transmit antenna 3 are advantageously rotatable with respect to each other to modify the polarization of incident wave $E_i$. Thus, a rotation by 90° of transmit antenna 3 with respect to receive antenna 2 enables to pass, for example, from a vertical polarization of incident wave E; to a horizontal polarization of transmitted wave $E_t$.

Receive antenna 2 and transmit antenna 3 are electrically connected to each other, to be powered and coupled, partly via a main via 8, preferably central, preferably metallic. Main via 8 crosses an opening formed in ground plane 5. Main via 8 is not in contact with ground plane 5. As an example, for a 60-GHz operating frequency, main via 8 preferably has a diameter in the order of 100 μm. Ground plane 5 forms an electromagnetic shielding between receive antenna 2 and transmit antenna 3. Preferably, receive antenna 2 is electrically connected to ground plane 5 via vias 80, preferably metallic. As an example, for a 60-GHz operating frequency, vias 80 preferably have a diameter in the order of 75 μm. Main via 8 is preferably connected to receive antenna 2 by a first connection point (not shown). The connection point is advantageously located close to an edge of receive antenna 2 to avoid affecting the radiation thereof when receive antenna 2 is of square type. The connection point is advantageously located close to the center of receive antenna 2 when receive antenna 2 is of U-shaped slot type. Generally, the position of the connection point varies according to the specific geometry of receive antenna 2 to excite the fundamental resonance mode. Second surface 91 of second board 9 advantageously comprises bump contacts 910, 910'. Wafer 7 advantageously comprises solder bumps B, preferably metallic, soldered to bump contacts 910, 910' to assemble wafer 7 to second board 9. Bump contacts 910' are advantageously located at the periphery of second surface 91 of second board 9 to ensure a good mechanical behavior of unit cell 1. Bump contacts 910 further ensure an electric connection in conjugation with solder bumps B. Main via 8 is preferably connected to transmit antenna 3 by a second connection point (not shown) via a solder bump B soldered to a bump contact 910. The second connection point is advantageously located close to the center of transmit antenna 3 to favor the fundamental resonance mode.

Figure 9:
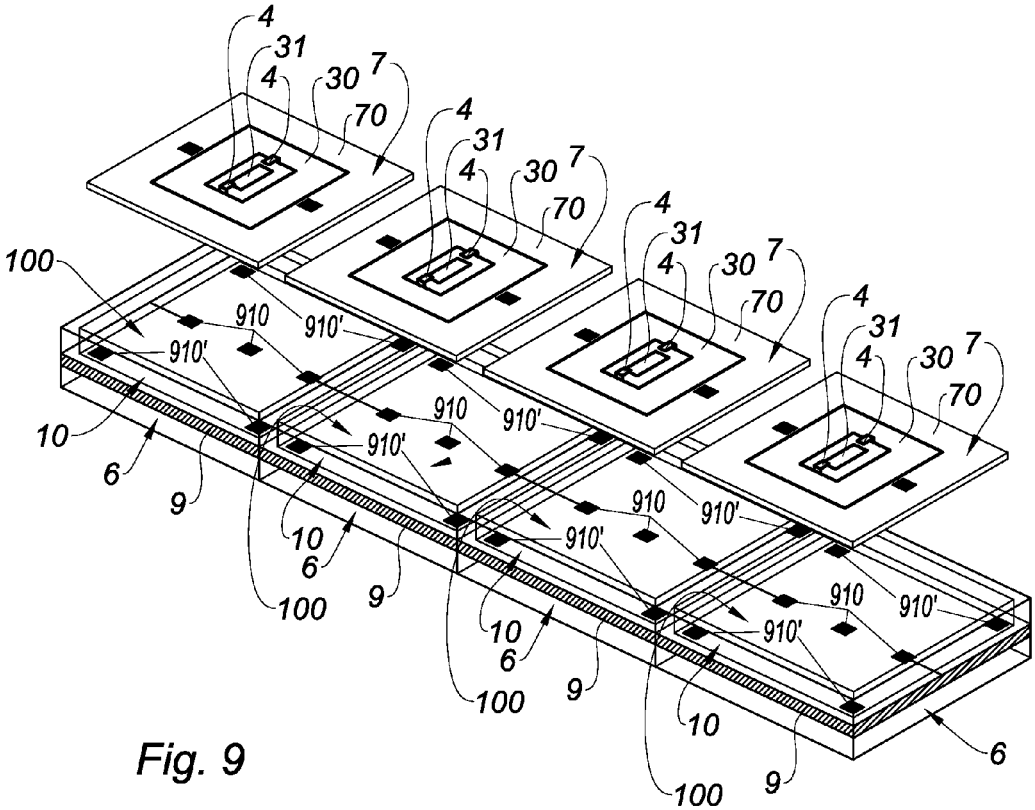
FIG. 9 is a simplified exploded perspective view of a plurality of unit cells according to an embodiment of the invention.

As illustrated in FIG. 9, unit cell 1 advantageously comprises a substrate 10 of a dielectric material assembled to second surface 71 of the second board, and substrate 10 comprises a cavity 100 shaped to receive wafer 7. Thus, cavity 100 of substrate 10 and bump contacts 910, 910' provide a good alignment of wafer 7 relative to second printed circuit board 9.

Figure 4:
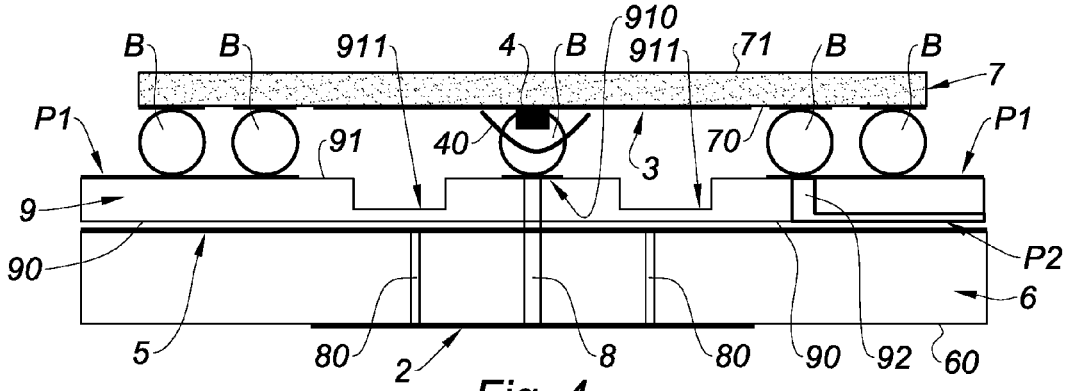
Figure 5A:
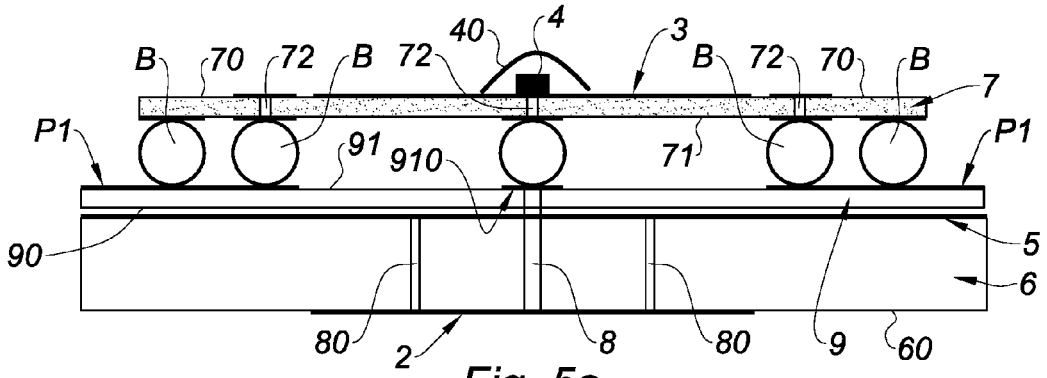
FIGS. 5*a* and 5*b* are simplified transverse cross-section views of a unit cell according to a second embodiment.
Figure 5B:
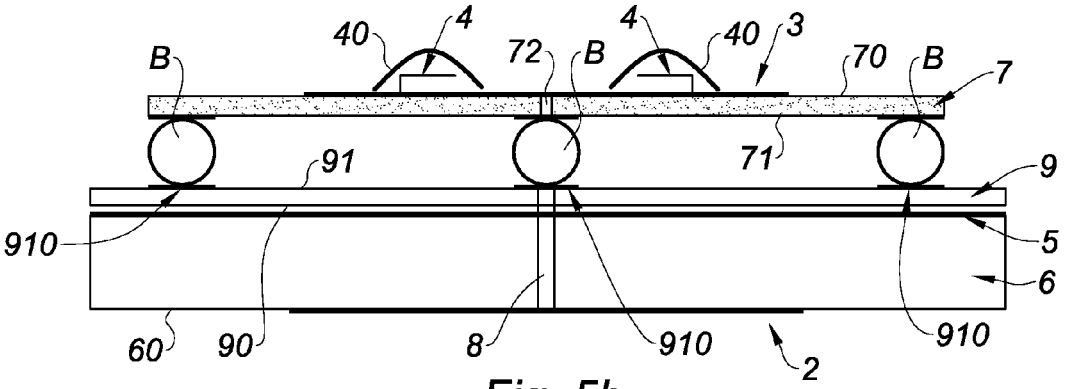

The phase-shift circuit advantageously comprises a first assembly of electrically-conductive tracks P1, arranged at second surface 91 of second board 9 to bias switches 4, and thus form means for controlling switches 4. Bump contacts 910 are advantageously electrically connected to the first assembly of electrically-conductive tracks P1. As illustrated in FIG. 4, the phase-shift circuit advantageously comprises:

- a second assembly of electrically-conductive tracks P2, arranged at first surface 90 of second board 9 to bias the switches,
- vias 92, preferably metallic, formed in second board 9 to connect the first and second assemblies of electrically-conductive tracks P1, P2.

The phase-shift circuit advantageously comprises first and second transmission lines LT1, LT2 arranged at first surface 70 of wafer 7. First transmission lines LT1 are arranged to connect tracks P1 to switches 4 to be able to control switches 4. Second transmission lines LT2 are arranged in separation area ZS to transfer the ground to switches 4. When second surface 71 of wafer 7 is assembled to second surface 91 of second board 9, unit cell 1 advantageously comprises vias 72 formed in wafer 7, such as TSVs (through silicon vias) when the semiconductor material is based on silicon. Vias 72 are arranged to electrically connect the first and second transmission lines LT1, LT2 to the first assembly of tracks P1.

The phase-shift circuit advantageously comprises two switches 4 arranged on either side of the second connection point in separation area ZS. The two switches 4 may form two independent components or a single SPDT-type component (Single Pole Double Throw), with one switched input and two switched outputs. Switches 4 are advantageously arranged to join first and second radiation surfaces 30, 31 to allow the flowing of a current between first and second radiation surfaces 30, 31 in the on state. Second radiation surface 31 advantageously has an area which is sufficiently small to avoid the occurrence of parasitic radiations and sufficiently large to convey the current from the second connection point to switches 4.

Switches 4 are advantageously electrically connected to solder bumps B. Solder bumps B preferably have a diameter in the order of 100 μm. The two switches 4 are advantageously alternately controlled so that, when one of switches 4 is in the on state, the other switch 4 is in the off state. Wave $E_t$ transmitted by transmit antenna 3 can thus be in phase with incident wave $E_i$ or phase-shifted by 180°. Switches 4 are configured to excite transmit antenna 3 in phase or in phase opposition with receive antenna 2.

Figure 8A:
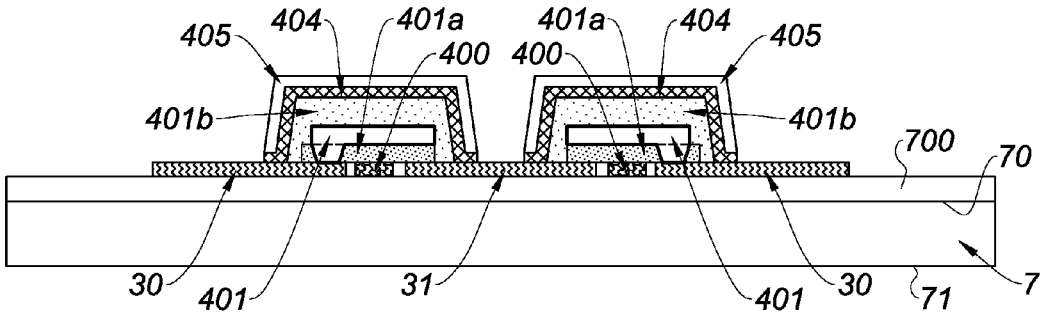
FIGS. 8*a* to 8*b* are simplified cross-section views of two embodiments of switches.

According to an execution mode illustrated in FIG. 8*a*, each switch 4 is a micro-electromechanical system comprising:

- a fixed actuation electrode 400, formed at first surface 70 of wafer 7;
- a membrane 401, formed at first radiation surface 30 of transmit antenna 3, and mobile between:

a first position, corresponding to the on state, where membrane 401 is in contact with second radiation surface 31 of transmit antenna 3; and a second position, corresponding to the off state, where membrane 401 is distant from second radiation surface 31 of transmit antenna 3.

The switching from the off state to the on state is performed by applying a potential difference, preferably in the order of 30 V, between actuation electrode 400 and membrane 401. Actuation electrode 400 is made of an electrically-conductive material, preferably a metallic material such as Au. Membrane 401 is made of an electrically-conductive material, preferably a metallic material. The forming of the micro-electromechanical system may require using a first sacrificial layer 401*a*, for example, made of amorphous silicon, deposited on actuation electrode 400. First sacrificial layer 401*a* is locally etched to form an electric contact for the electrically-conductive material of actuation electrode 400. Elementary cell 1 advantageously comprises an encapsulation layer 40 arranged to encapsulate each micro-electromechanical system, encapsulation layer 40 being formed monolithically with the corresponding micro-electromechanical system. As an example, to achieve this, a second sacrificial layer 401*b*, such as a resist, is deposited on the corresponding micro-electromechanical system. Then, a silicon dioxide layer 404 is deposited on second sacrificial layer 401*b*. Holes are formed in layer 404 to remove first and second sacrificial layers 401*a*, 401*b*. Then, the holes are closed, for example, with a polymer material 405, preferably benzocyclobutene. Silicon dioxide layer 404 and polymer material 405 form encapsulation layer 40.

Figure 8B:
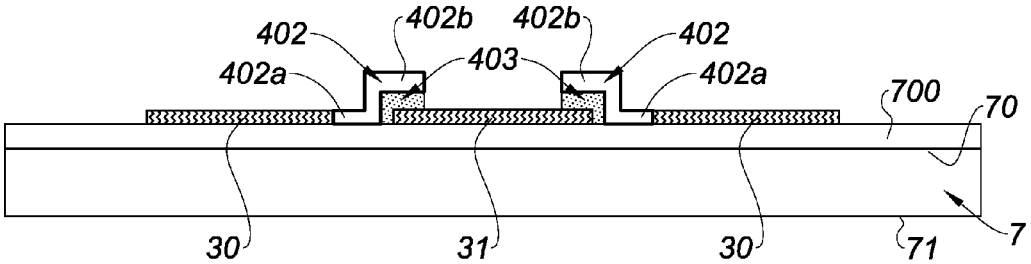

According to an alternative embodiment illustrated in FIG. 8*b*, each switch 4 comprises:

an electrically-conductive element 402 comprising a first portion 402*a* formed at first surface 70 of wafer 7, in contact with first radiation surface 30 of transmit antenna 3, and a second portion 402*b* extending opposite second radiation surface 31 of transmit antenna 3;

a layer 403 of a phase-change material, arranged between second radiation surface 31 of transmit antenna 3 and second portion 402*b* of the electrically-conductive element 402, the phase-change material having a crystal phase corresponding to the on state, and an amorphous phase corresponding to the off state. Advantageously, the phase-change material is preferably selected from the group comprising GeTe, $Ge_2Sb_2Te_5$. The reversible switching from the off state to the on state is performed under the effect of a thermal pulse applied by a current peak generating a Joule effect in the phase-change material.

Other execution modes may be envisaged for switches 4. As non-limiting examples, radio switches 4 such as diodes, transistors, photodiodes, phototransistors are possible. The selection of a device to control switches 4 depends on the selected technology. As examples, the following devices may be used:

an optical fiber for a switch 4 of photoelectric type, a laser beam generated by outer means and exciting a switch of photoelectric type, an electromagnetic wave according to the known principles of remote supply in the field of RFID (Radio Frequency Identification).

The invention claimed is:

1. A transmitarray unit cell for an antenna reconfigurable at an operating frequency, including:

a receive patch antenna, intended to receive an incident wave;

a transmit patch antenna intended to transmit the incident wave with a phase shift, and comprising first and second radiation surfaces separated from each other by a separation area so as to be electrically isolated;

a phase-shift circuit configured to introduce the phase shift, and comprising switches, each having an on, respectively off, state, wherein the corresponding switch allows, respectively blocks, the flowing of a current between the first and second radiation surfaces of the transmit patch antenna;

a ground plane having the receive patch antenna and the transmit patch antenna arranged on either side thereof;

a first printed circuit board comprising a first surface provided with the receive patch antenna and a second opposite surface provided with the ground plane;

a wafer of a semiconductor material, electrically isolated from the ground plane, and comprising a first surface provided with the first and second radiation surfaces of the transmit patch antenna;

wherein the switches are formed at the first surface of the wafer, in the separation area, monolithically with the transmit patch antenna.

2. The transmitarray unit cell according to claim 1, including a second printed circuit board comprising a first surface assembled on the ground plane, and a second opposite surface; and wherein the wafer is assembled to the second surface of the second printed circuit board.

3. The transmitarray unit cell according to claim 2, including a substrate of a dielectric material assembled to the second surface of the second printed circuit board; and wherein the substrate includes a cavity shaped to receive the wafer.

4. The transmitarray unit cell according to claim 2, wherein the phase-shift circuit includes a first assembly of electrically-conductive tracks arranged at the second surface of the second printed circuit board to bias the switches.

5. The transmitarray unit cell according to claim 4, wherein the phase-shift circuit includes:

a second assembly of electrically-conductive tracks, arranged at the first surface of the second printed circuit board to bias the switches;

vias formed in the second printed circuit board to connect the first and second assemblies of electrically-conductive tracks.

6. The transmitarray unit cell according to claim 2, wherein the second surface of the second printed circuit board includes bump contacts; and wherein the wafer includes solder bumps soldered to the bump contacts to assemble the wafer to the second printed circuit board.

7. The transmitarray unit cell according to claim 6, wherein the phase-shift circuit includes a first assembly of electrically-conductive tracks arranged at the second surface of the second printed circuit board to bias the switches; wherein the bump contacts are electrically connected to the first assembly of electrically-conductive tracks, and wherein the switches are electrically connected to the solder bumps.

8. The transmitarray unit cell according to claim 2, wherein the second surface of the second printed circuit board includes at least one cavity formed opposite the transmit patch antenna.

9. The transmitarray unit cell according to claim 1, wherein each switch is a micro-electromechanical system including:

a fixed actuation electrode, formed at the first surface of the wafer;

a membrane, formed at the first radiation surface of the transmit patch antenna, and mobile between:

a first position, corresponding to the on state, where the membrane is in contact with the second radiation surface of the transmit patch antenna; and a second position, corresponding to the off state, where the membrane is distant from the second radiation surface of the transmit patch antenna.

10. The transmitarray unit cell according to claim 9, including an encapsulation layer arranged to encapsulate each micro-electromechanical system, the encapsulation layer being formed monolithically with the corresponding micro-electromechanical system.

11. The transmitarray unit cell according to claim 1, wherein each switch includes:

an electrically-conductive element comprising a first portion formed at the first surface of the wafer, in contact with the first radiation surface of the transmit patch antenna, and a second portion extending opposite the second radiation surface of the transmit patch antenna;

a layer of a phase-change material, arranged between the second radiation surface of the transmit patch antenna and the second portion of the electrically-conductive element, the phase-change material having a crystal phase corresponding to the on state, and an amorphous phase corresponding to the off state.

12. The transmitarray unit cell according to claim 11, wherein the phase-change material is selected from the group comprising GeTe, $Ge_2Sb_2Te_5$.

13. The transmitarray unit cell according to claim 1, wherein the wafer has a resistivity greater than or equal to 2,000 Ω·cm.

14. The transmitarray unit cell according to claim 1, wherein the semiconductor material of the wafer is based on silicon.

15. The transmitarray unit cell according to claim 1, wherein the operating frequency is in the range from 30 GHz to 110 GHz.

16. An antenna reconfigurable at an operating frequency, including a transmitarray comprising a plurality of transmitarray unit cells according to claim 1.

* * * * *